US011261703B1

(12) United States Patent
Helms

(10) Patent No.: US 11,261,703 B1
(45) Date of Patent: Mar. 1, 2022

(54) DUAL VALVES FOR REVERSE CEMENTING OPERATIONS

(71) Applicant: Halliburton Energy Services, Inc., Houston, TX (US)

(72) Inventor: Lonnie Carl Helms, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/080,960

(22) Filed: Oct. 27, 2020

(51) Int. Cl.
*E21B 34/14* (2006.01)
*E21B 33/14* (2006.01)

(52) U.S. Cl.
CPC ..... *E21B 34/142* (2020.05); *E21B 33/146* (2013.01)

(58) Field of Classification Search
CPC ..... E21B 33/14; E21B 34/142; E21B 2200/05
See application file for complete search history.

(56) References Cited

U.S. PATENT DOCUMENTS

| | | | | |
|---|---|---|---|---|
| 3,948,322 | A | 4/1976 | Baker | |
| 4,474,241 | A | 10/1984 | Freeman | |
| 4,729,432 | A | 3/1988 | Helms | |
| 4,825,902 | A * | 5/1989 | Helms | F16K 15/033 137/515 |
| 6,244,342 | B1 * | 6/2001 | Sullaway | E21B 21/10 166/285 |
| 6,725,935 | B2 * | 4/2004 | Szarka | E21B 21/10 166/318 |
| 6,802,374 | B2 | 10/2004 | Edgar et al. | |
| 8,646,531 | B2 * | 2/2014 | King | E21B 34/14 166/318 |
| 10,344,558 | B2 | 7/2019 | Gao et al. | |
| 2002/0148614 | A1 | 10/2002 | Szarka et al. | |
| 2006/0278395 | A1 * | 12/2006 | Kenison | E21B 34/066 166/312 |
| 2018/0238139 | A1 * | 8/2018 | Gao | E21B 47/005 |
| 2021/0246759 | A1 * | 8/2021 | Cao | E21B 34/142 |

FOREIGN PATENT DOCUMENTS

| | | | |
|---|---|---|---|
| EP | 2290192 | A1 | 3/2011 |
| WO | 0169037 | A1 | 9/2001 |

* cited by examiner

*Primary Examiner* — Shane Bomar
(74) *Attorney, Agent, or Firm* — Sheri Higgins Law, PLLC; Sheri Higgins

(57) ABSTRACT

A dual valve downhole tool for reverse cementing in a wellbore can include: a body configured to fit within a casing string; an inner sleeve located within the body; a first valve located within the body and configured to open and close a fluid flow path through the body, and wherein the first valve is configured to be in an open position during placement of the downhole tool in the wellbore; and a second valve located within the body and configured to open and close the fluid flow path through the body, wherein the second valve is configured to be in a closed position during placement of the downhole tool in the wellbore, and wherein shifting of the inner sleeve after placement of the downhole tool closes the first valve and opens the second valve. Reverse cementing can commence after the second sleeve has converted to the open position.

20 Claims, 5 Drawing Sheets

DUAL VALVES FOR REVERSE CEMENTING OPERATIONS

TECHNICAL FIELD

The field relates to reverse cementing in an oil or gas operation. Dual flapper valves can be used to perform the reverse cementing operation.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
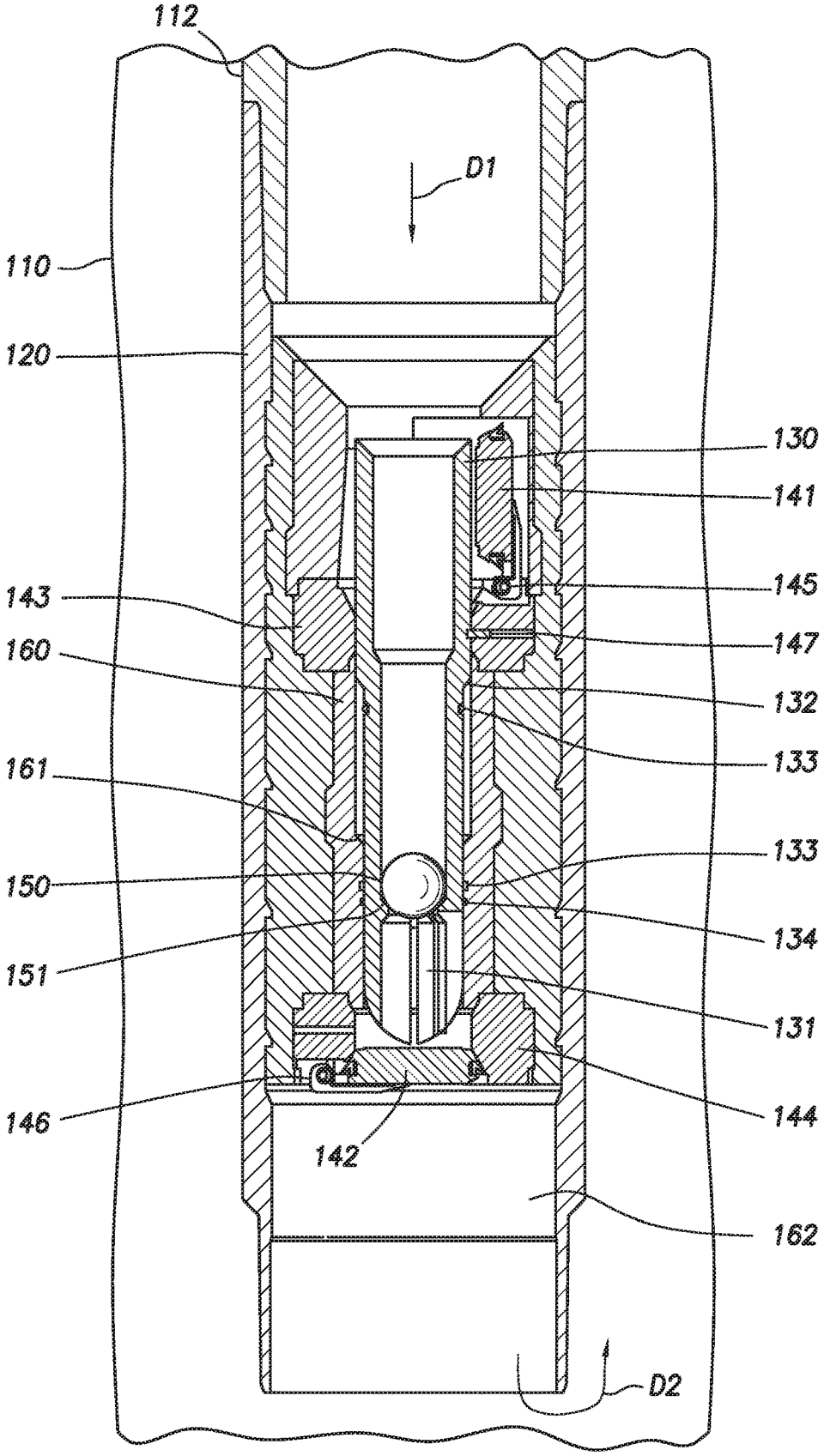
FIG. 1 illustrates a downhole tool during run in with a first flapper valve in an open position and a second flapper valve in a closed position according to certain embodiments.

Oil and gas hydrocarbons are naturally occurring in some subterranean formations. In the oil and gas industry, a subterranean formation containing oil and/or gas is referred to as a reservoir. A reservoir can be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid.

As used herein, a "fluid" is a substance having a continuous phase that can flow and conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase; whereas a heterogeneous fluid has more than one distinct phase. A colloid is an example of a heterogeneous fluid. A heterogeneous fluid can be: a slurry, which includes a continuous liquid phase and undissolved solid particles as the dispersed phase; an emulsion, which includes a continuous liquid phase and at least one dispersed phase of immiscible liquid droplets; a foam, which includes a continuous liquid phase and a gas as the dispersed phase; or a mist, which includes a continuous gas phase and liquid droplets as the dispersed phase. As used herein, the term "base fluid" means the solvent of a solution or the continuous phase of a heterogeneous fluid and is the liquid that is in the greatest percentage by volume of a treatment fluid.

A well can include, without limitation, an oil, gas, or water production well, an injection well, or a geothermal well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a subterranean formation" means and includes into any portion of the well, including into the wellbore, into the near-wellbore region via the wellbore, or into the subterranean formation via the wellbore.

A wellbore is formed using a drill bit. A drill string can be used to aid the drill bit in drilling through the subterranean formation to form the wellbore. The drill string can include a drilling pipe. During drilling operations, a drilling fluid, sometimes referred to as a drilling mud, may be circulated downwardly through the drilling pipe, and back up the annulus between the wellbore and the outside of the drilling pipe. The drilling fluid performs various functions, such as cooling the drill bit, maintaining the desired pressure in the well, and carrying drill cuttings upwardly through the annulus between the wellbore and the drilling pipe.

A portion of a wellbore can be an open hole or cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

During well completion, it is common to introduce a cement composition into an annulus in a wellbore. For example, in a cased-hole wellbore, a cement composition can be placed into and allowed to set in the annulus between the wellbore and the casing in order to stabilize and secure the casing in the wellbore. By cementing the casing in the wellbore, fluids are prevented from flowing into the annulus. Consequently, oil or gas can be produced in a controlled manner by directing the flow of oil or gas through the casing and into the wellhead. Cement compositions can also be used in primary or secondary cementing operations, well-plugging, or squeeze cementing. As used herein, a "cement composition" is a mixture of at least cement and water, and possibly other additives.

As used herein, a "cement composition" is a mixture of at least cement and water. A cement composition can include additives. As used herein, the term "cement" means an initially dry substance that develops compressive strength or sets in the presence of water. Some examples of cements include, but are not limited to, Portland cements, gypsum cements, high alumina content cements, slag cements, high magnesia content cements, sorel cements, and combinations thereof. A cement composition is a heterogeneous fluid including water as the continuous phase of the slurry and the cement (and any other insoluble particles) as the dispersed phase. The continuous phase of a cement composition can include dissolved substances.

A spacer fluid can be introduced into the wellbore after the drilling fluid and before the cement composition. The spacer fluid can be circulated down through a drill string or tubing string and up through the annulus. The spacer fluid functions to remove the drilling fluid from the wellbore.

In traditional cementing operations, a spacer fluid is typically introduced after the drilling fluid into the casing.

The spacer fluid pushes the drilling fluid through the casing and up into an annular space towards a wellhead. A cement composition is then introduced after the spacer fluid into the casing. There can be two cement compositions—often called a lead cement and tail cement—that have different properties, such as density, introduced into the wellbore.

A cement composition should remain pumpable during introduction into a wellbore. A cement composition will ultimately set after placement into the wellbore. As used herein, the term "set," and all grammatical variations thereof, are intended to mean the process of becoming hard or solid by curing. As used herein, the "setting time" is the difference in time between when the cement and any other ingredients are added to the water and when the composition has set at a specified temperature. It can take up to 48 hours or longer for a cement composition to set. Some cement compositions can continue to develop compressive strength over the course of several days. The compressive strength of a cement composition can reach over 10,000 psi (69 MPa).

Reverse cementing operations were developed to overcome some of the disadvantages to traditional cement operations. For example, in traditional cementing operations, the setting time of the cement composition is longer in order for the cement slurry to travel through the casing or an inner tubing string and back up into the annulus before setting. Additionally, the amount of cement slurry that is pumped is generally greater than in reverse cementing. In reverse cementing, the cement slurry is pumped directly into the annulus instead of into the annulus via the casing string or tubing string. Accordingly, reverse cementing generally requires less of the cement slurry, faster setting times, and lower pump pressures because gravity assists the cement slurry in being placed in the annulus.

To perform reverse cementing operations successfully, the ability of holding displaced cement in place has proven to be difficult. One method of reverse cementing utilizes an inner tubing or drill string to prop open a check valve for the duration of reverse cementing. Once completed, retracting the tubing or drill string from the check valve allows it to close and check the further flow of cement into the casing string. The use of an inner string is expensive, requiring extra equipment, time, and personnel to complete the job. Thus, there is a need for improved ways to perform a reverse cementing operation that requires less time, money, and personnel.

A downhole tool can be used to perform a reverse cementing operation. The downhole tool can include two valves that are used to contain the cement slurry in the annulus. The downhole tool facilitates both circulating fluids conventionally through the casing string while being run into the well, as well as providing a backpressure valve for cementing in the reverse direction. The downhole tool can be run into the wellbore with a casing string and eliminates the need for an additional inner tubing string.

A downhole tool for reverse cementing in a wellbore, the downhole tool comprising: a body configured to fit within a casing string; an inner sleeve located within the body; a first valve located within the body and configured to open and close a fluid flow path through the body, and wherein the first valve is configured to be in an open position during placement of the downhole tool in the wellbore; and a second valve located within the body and configured to open and close the fluid flow path through the body, wherein the second valve is configured to be in a closed position during placement of the downhole tool in the wellbore, and wherein shifting of the inner sleeve after placement of the downhole tool closes the first valve and opens the second valve.

Methods of reverse cementing in a wellbore comprising: introducing a casing string and the downhole tool installed within the casing string into the wellbore, wherein the first valve is in an open position and the second valve is in a closed position during introduction of the casing string and the downhole tool into the wellbore; causing the inner sleeve to shift after introduction of the casing string and the downhole tool into the wellbore, wherein the first valve converts to a closed position and the second valve converts to an open position after the inner sleeve has shifted; and introducing a cement composition into an annulus located between a wall of the wellbore and an outside of the casing string.

It is to be understood that the discussion of any of the embodiments regarding the downhole tool is intended to apply to all of the method and appartus embodiments without the need to repeat the various embodiments throughout. Any reference to the unit "gallons" means U.S. gallons.

Turning to the figures, FIG. 1 illustrates the downhole tool during introduction into a wellbore—commonly known in the industry as being run-in. The downhole tool includes a body 120. The body 120 can be configured to fit within a casing string 112, for example, via casing box X pin connectors. The casing string 112 and the downhole tool can be introduced into a wellbore that is defined by a wellbore wall 110. An annulus can be defined as the space located between the wellbore wall 110 and the outside of the casing string 112 and body 120.

The downhole tool can include an inner sleeve 130 and a valve connector housing 160. The inner sleeve 130 can be releasably attached to the valve connector housing 160 by a frangible device 147. The frangible device 147 can be any device that is capable of withstanding a predetermined amount of force and capable of releasing at a force above the predetermined amount of force. The frangible device 147 can be, for example, a shear pin, a shear screw, a shear ring, a load ring, a lock ring, a pin, or a lug. There can also be more than one frangible device 147 that connects the inner sleeve 130 to the valve connector housing 160. The frangible device 147 or multiple frangible devices can be selected based on the force rating of the device, the total number of devices used, and the predetermined amount of force needed to release the device. For example, if the total force required to break or shear the frangible device is 15,000 pounds force ($lb_f$) and each frangible device has a rating of 5,000 $lb_f$, then a total of three frangible devices may be used.

The downhole tool also includes a first valve 141 and a second valve 142. The first and second valves 141/142 can be flapper valves. As shown in FIG. 1, the downhole tool is shown in the run-in position wherein the first valve 141 is in an open position and the second valve 142 is in a closed position. In practice, drilling mud is usually introduced along with the casing string 112 and the downhole tool from a wellhead in the direction D1. As shown, the first valve 141 is located above the second valve 142 at a location that is closer to the wellhead. With the first valve 141 held in the open position during run-in via the inner sleeve 130, the run-in fluid (e.g., a drilling mud) can flow within a fluid flow path through the body 120 in the direction D1. The second valve 142 can partially or fully open when a sufficient volume of run-in fluid enters the downhole tool. The second valve will naturally return to the closed position if pumping of the run-in fluid stops. The run-in fluid can then enter the annulus in the direction D2. The inner sleeve 130 can also include a sealing element 134 that restricts or prevents fluid flow between the outside of the inner sleeve 130 and the inside of the valve connector housing 160.

The methods can include causing the inner sleeve 130 to shift after introduction and placement of the casing string 112 and the downhole tool into the wellbore. The downhole tool can include a ball seat 151 that is located on the inner sleeve 130 above the second valve 142. After the downhole tool has been placed at the desired location within the wellbore, a ball 150 can be introduced into the casing string 112 and be flowed through the inner sleeve 130 of the downhole tool. It is to be understood that reference to a "ball" is not meant to limit the geometric shape of the ball to spherical, but rather is meant to include any device that is capable of engaging with a seat. A "ball" can be spherical in shape, but can also be a dart, a bar, or any other shape. Shifting of the inner sleeve 130 can be accomplished via a ball and seat by dropping the ball from the wellhead onto the seat that is located within the downhole tool. The ball 150 engages with the ball seat 151, and the seal created by this engagement prevents fluid communication downstream of the ball and seat. A pressure differential is created after the seal is created by engagement of the ball 150 with the ball seat 151. The pressure differential can cause the frangible device 147 to shear, thereby releasing the inner sleeve 130 from connection with the valve connector housing 160.

Figure 2:
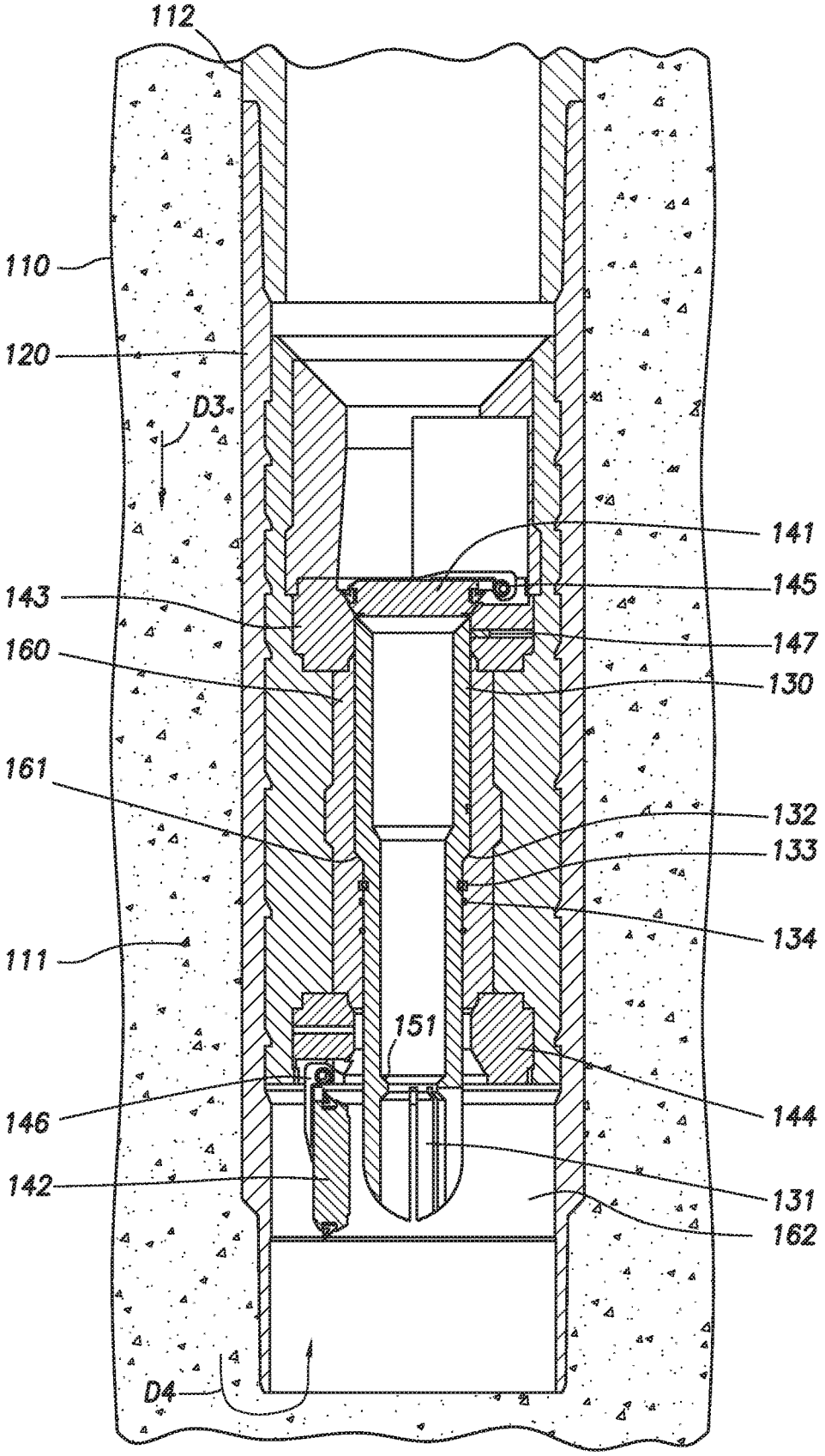
FIG. 2 illustrates the downhole tool during a reverse cementing operation with the first flapper valve in a closed position and the second flapper valve in an open position according to certain embodiments.

Turning now to FIG. 2, the inner sleeve 130 is caused to move downward within the body 120 due to the pressure differential and shearing of the frangible device 147. A lower end of the inner sleeve 130 causes a flapper on the second valve 142 to convert from the closed position shown in FIG. 1 to an open position as shown in FIG. 2. The flap can rotate into the open position via a hinge 146 on a second valve body 144.

The inner sleeve 130 can continue to travel in a downward direction until a sleeve shoulder 132 shoulders up against a valve connector housing shoulder 161. Continued travel of the inner sleeve 130 is prevented after the sleeve shoulder 132 engages with the valve connector housing shoulder 161. The inner sleeve 130 and the valve connector housing 160 can also include a lock ring 133. The lock ring 133 can become locked as shown in FIG. 2 after shouldering occurs. Locking of the lock ring 133 can help secure the inner sleeve 130 from further movement within the body 120.

As can also be seen in FIG. 2, the downward movement of the inner sleeve 130 can cause the first valve 141 to convert from an open position into a closed position. As the inner sleeve 130 moves downward, a flapper of the first valve 141 is no longer held open by the inner sleeve 130 and can rotate into the closed position via a hinge 145 located on a first valve body 143. A bottom portion of the inner sleeve 130 can push a flapper of the second valve 142 open and continue to travel downward into a bottom portion 162 of the downhole tool. The second valve 142 can be locked in the open position via the inner sleeve 130. Although shown in the figures with the first valve hinge 145 being located opposite from the second valve hinge 146, it is to be understood that the hinges 145/146 can be located on the same side of the valve connector housing 160.

Figure 3:
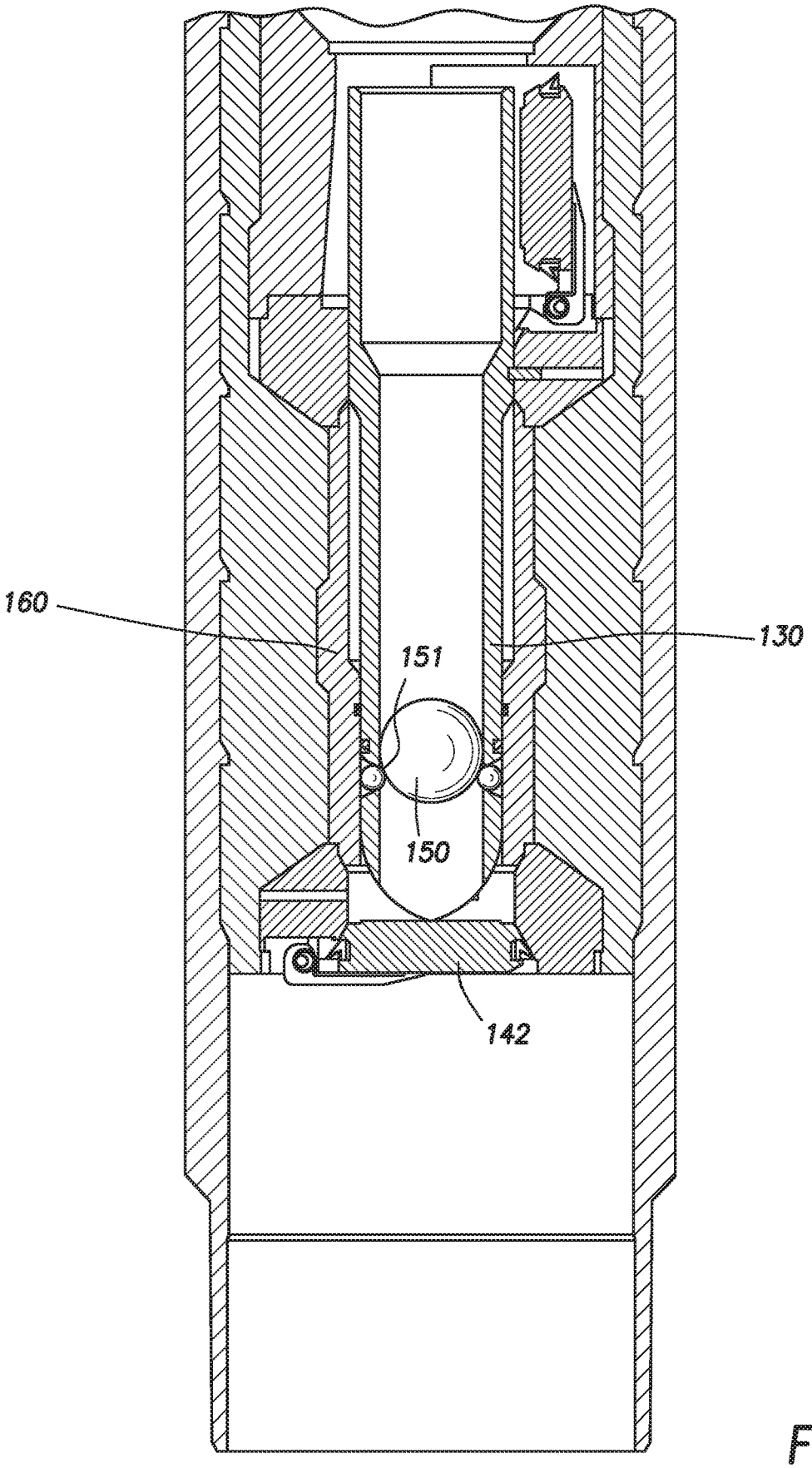
FIG. 3 illustrates the downhole tool showing a ball seat according to certain embodiments.
Figure 4:
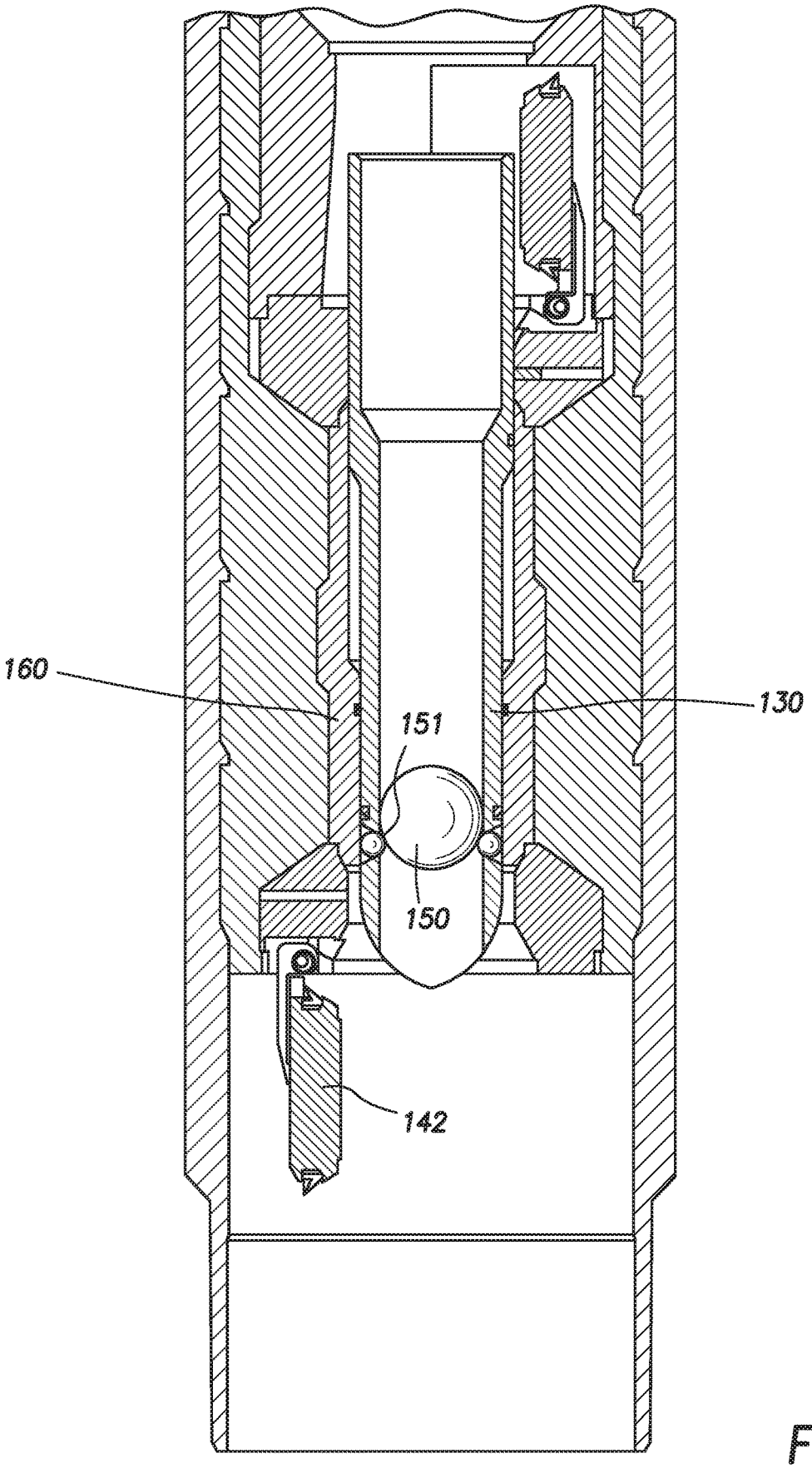
FIG. 4 illustrates the ball seat of FIG. 3 with a ball passing through the ball seat.
Figure 5:
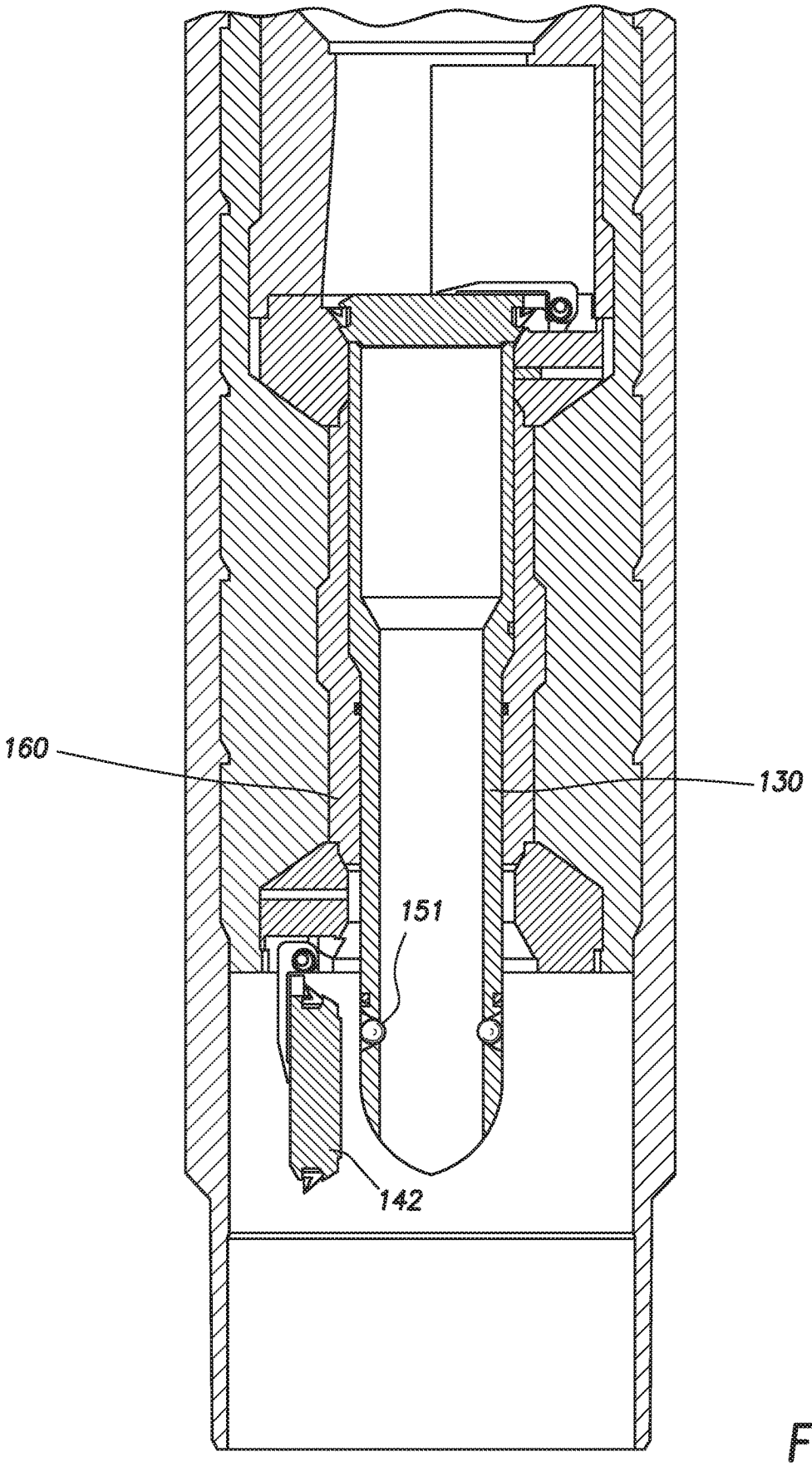
FIG. 5 illustrates the ball seat of FIG. 3 after the ball has disengaged from the ball seat and flowed into a wellbore.

The methods can further include causing or allowing the ball 150 to disengage from the ball seat 151 after the inner sleeve 130 has shouldered up, as shown in FIG. 2. The ball 150, the ball seat 151, and/or the inner sleeve 130 can be configured to allow the ball to disengage from the ball seat 151. By way of a first example and as shown in FIGS. 3-5, the ball seat 151 can comprise a plurality of buttons. The buttons can be positioned within a plurality of receivers located around the periphery of the inner sleeve 130. Preferably, the ball seat 151 comprises at least 4 buttons spaced equally from one another circumferentially around the inner sleeve 130. The number of buttons located around the inner sleeve 130 can range from 4 to 20. As shown in FIG. 3, the buttons penetrate into the fluid flow path of the inner sleeve 130 and are held in this position by engagement with an inner diameter of the valve connector housing 160. This penetration into the inner sleeve 130 creates a ball seat 151 for the ball 150 to engage with the ball seat. As shown in FIG. 4, once the inner sleeve 130 moves downward into the bottom portion 162 of the downhole tool, the valve connector housing 160 no longer holds the buttons in the position that penetrates into the inner sleeve 130. Accordingly, the ball 150 can push the buttons radially outward; thus, allowing the ball 150 to flow through the ball seat 151 in the direction D1. FIG. 5 shows the position of the buttons after the ball 150 has flowed through the downhole tool and into the wellbore.

By way of another example and as shown in FIG. 2, the inner sleeve 130 can be configured to allow the ball 150 to move past the ball seat 151 in the direction D1. The inner sleeve 130 can include a plurality of fingers 131. The fingers 131 can be interconnected at an upper end (e.g., directly below the ball seat 151) and disconnected from each other at a lower end. In this manner, as the fingers 131 travel into the bottom portion 162 of the downhole tool, the fingers 131 can expand away from each other, which allows the ball 150 to disengage from the ball seat 151 and flow through the fingers 131 into the wellbore. It is to be understood that other configurations not shown or described can be utilized that allows the ball 150 to disengage from the ball seat 151.

By way of yet another example, the ball 150 can be made from a dissolvable or meltable material. Partial dissolution or melting of the ball can allow the ball to deform and extrude past the ball seat. The ball can also completely dissolve or melt thereby causing disengagement of the ball with the ball seat.

The second valve 142 is maintained in the open position and prevented from closing due to the protrusion of the lower end of the inner sleeve 130 into the bottom portion 162 of the downhole tool. A surface indicator at the wellhead can signal that the second valve 142 is in the open position and reverse cementing can commence.

The components of the downhole tool can be made from a variety of components including, but not limited to, metals, metal alloys, composites, plastics, and rubbers.

The methods include introducing a cement composition 111 into an annulus located between a wall 110 of the wellbore and an outside of the casing string 112. The annulus and inside of the casing string 112 can contain a fluid. The fluid can be a run-in fluid, for example, a drilling mud. The methods can include introducing a first fluid into the annulus prior to introduction of the cement composition 111. The first fluid can be a spacer fluid. A spacer fluid can help separate a drilling mud from the cement composition 111. The cement composition 111 can then be introduced into the annulus. There can also be a second, third, etc. fluid introduced into the annulus after the first fluid and before the cement composition 111. Any of the fluids can be introduced into the annulus in the direction D3 and can enter the downhole tool in the direction D4. The first valve 141 can open as fluids enter the inner sleeve 130 from direction D4.

According to any of the embodiments, hydrostatic equilibrium is achieved during and after introduction of the cement composition 111. A wellbore segment can have a specific hydrostatic pressure. The hydrostatic pressure in the wellbore segment can be pre-determined. As used herein, "hydrostatic pressure" is the force per unit area exerted by a column of wellbore fluid at rest. In U.S. oilfield units, hydrostatic pressure is calculated using the equation: P=MW*Depth*0.052, where MW is the drilling fluid density in pounds per gallon, Depth is the true vertical depth or "head" in feet, and 0.052 is a unit conversion factor chosen such that P results in units of pounds per square inch (psi). The hydrostatic pressure is the force exerted on the wellbore components, such as a tubing string or casing, or a subterranean formation for an open-hole wellbore portion, via the fluid located in the wellbore or in a tubing string. According to these embodiments, hydrostatic equilibrium exists when the hydrostatic pressure of the column of fluid in the annulus equals the hydrostatic pressure of the column of fluid in the casing string.

The density of any fluids introduced before the cement composition as well as the density of the cement composition can be selected such that hydrostatic equilibrium occurs. There can also be a second cement composition that is introduced into the annulus. For example, a first cement composition, such as a lead cement slurry, can be introduced into the annulus—followed by a second cement composition, such as a tail cement slurry that has a different density. The following is one, non-limiting example of a density design of fluids to achieve hydrostatic equilibrium. A 9 pound per gallon (ppg) drilling mud can be located within the casing and annulus. A higher density spacer fluid, for example 12 ppg, can be pumped into the annulus when the reverse cementing operation begins. The heavier weight spacer fluid pushes the lighter weight drilling mud through the annulus in the direction D3. A lead cement slurry with a higher density than the drilling mud, but lighter than the spacer fluid, for example 11 ppg, can be pumped into the annulus. The lead cement will remain on top of the spacer fluid and allow the spacer fluid to continue pushing the drilling mud through the annulus and can enter the casing string 112 in the direction D4. A tail cement slurry can have a density less than the lead cement slurry, for example 10 ppg. After placement of all of the cement slurries in the annulus, hydrostatic equilibrium can be achieved with the column of fluid in the annulus having an average density of 10.5 ppg and the column of fluid in the casing string having an average density of 10.5 ppg. One of ordinary skill in the art will be able to select the density and volume of the fluids in order to achieve hydrostatic equilibrium.

An embodiment of the present disclosure is a downhole tool for reverse cementing in a wellbore, the downhole tool comprising: a body configured to fit within a casing string; an inner sleeve located within the body; a first valve located within the body and configured to open and close a fluid flow path through the body, and wherein the first valve is configured to be in an open position during placement of the downhole tool in the wellbore; and a second valve located within the body and configured to open and close the fluid flow path through the body, wherein the second valve is configured to be in a closed position during placement of the downhole tool in the wellbore, and wherein shifting of the inner sleeve after placement of the downhole tool closes the first valve and opens the second valve. Optionally, the downhole tool further comprises a valve connector housing, wherein the inner sleeve is releasably attached to the valve connector housing by a frangible device. Optionally, the downhole tool further comprises wherein the frangible device is selected from a shear pin, a shear screw, a shear ring, a load ring, a lock ring, a pin, or a lug. Optionally, the downhole tool further comprises a ball seat located on the inner sleeve at a location above the second valve. Optionally, the downhole tool further comprises wherein a ball engages with the ball seat to create a seal and a pressure differential, and wherein the pressure differential causes shifting of the inner sleeve.

Another embodiment of the present disclosure is a method of reverse cementing in a wellbore comprising: introducing a casing string and a downhole tool installed within the casing string into the wellbore, wherein the downhole tool comprises: a body configured to fit within a casing string; an inner sleeve located within the body; a first valve located within the body and configured to open and close a fluid flow path through the body; and a second valve located within the body and configured to open and close the fluid flow path through the body, wherein the first valve is in an open position and the second valve is in a closed position during introduction of the casing string and the downhole tool into the wellbore; causing the inner sleeve to shift after introduction of the casing string and the downhole tool into the wellbore, wherein the first valve converts to a closed position and the second valve converts to an open position after the inner sleeve has shifted; and introducing a cement composition into an annulus located between a wall of the wellbore and an outside of the casing string. Optionally, the method further comprises a ball seat located on the inner sleeve at a location above the second valve. Optionally, the method further comprises introducing a ball into the casing string and the inner sleeve, wherein the ball engages with the ball seat to create a seal and a pressure differential, and wherein the pressure differential causes shifting of the inner sleeve. Optionally, the method further comprises causing or allowing the ball to disengage from the ball seat after the inner sleeve has shifted. Optionally, the method further comprises a valve connector housing, wherein the inner sleeve is releasably attached to the valve connector housing by a frangible device, and wherein the inner sleeve is shifted after shearing of the frangible device. Optionally, the method further comprises wherein shifting of the inner sleeve causes a flapper of the first valve to rotate into the closed position via a hinge located on a first valve body. Optionally, the method further comprises wherein a lower end of the inner sleeve causes a flapper on the second valve to rotate into the open position via a hinge located on a second valve body during shifting of the inner sleeve. Optionally, the method further comprises a valve connector housing, an inner sleeve shoulder, and a valve connector housing shoulder, wherein the inner sleeve shifts in a downward direction until the inner sleeve shoulder shoulders up against the valve connector housing shoulder. Optionally, the method further comprises wherein the inner sleeve and the valve connector housing include a lock ring, and wherein the lock ring locks after shifting of the inner sleeve. Optionally, the method further comprises wherein a bottom portion of the inner sleeve comprises a plurality of fingers, and wherein the fingers expand away from each other allowing the ball to disengage from the ball seat and flow through the fingers into the wellbore. Optionally, the method further comprises wherein the ball seat comprises a plurality of buttons, wherein the buttons are positioned within a plurality of receivers located around a periphery of the inner sleeve, and wherein shifting of the inner sleeve allows the ball to push the buttons radially outward and disengage from the ball seat. Optionally, the method further comprises introducing a first fluid into the annulus prior to introduction of the cement composition. Optionally, the method further comprises wherein the first fluid is a spacer fluid. Optionally, the method further comprises wherein hydrostatic equilibrium is achieved during and after introduction of the cement composition. Optionally, the method further comprises pressure testing the casing string before, during, or after the cement composition has been introduced into the annulus, and wherein the cement composition is in a fluid form during the pressure testing.

Therefore, the apparatus, methods, and systems of the present disclosure are well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present disclosure.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more fluids, valves, etc., as the case may be, and does not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A downhole tool for reverse cementing in a wellbore, the downhole tool comprising:

a body configured to fit within a casing string;

an inner sleeve located within the body;

a first valve located within the body and configured to open and close a fluid flow path through the body, wherein the first valve opens in a direction towards a wellhead of the wellbore in an open position; and wherein the first valve is configured to be in the open position during placement of the downhole tool in the wellbore; and a second valve located within the body and configured to open and close the fluid flow path through the body, wherein the second valve is configured to be in a closed position during placement of the downhole tool in the wellbore, wherein shifting of the inner sleeve after placement of the downhole tool closes the first valve and opens the second valve, and wherein the second valve opens in a direction away from the wellhead of the wellbore in an open position.

2. The downhole tool according to claim 1, further comprising a valve connector housing, wherein the inner sleeve is releasably attached to the valve connector housing by a frangible device.

3. The downhole tool according to claim 2, wherein the frangible device is selected from a shear pin, a shear screw, a shear ring, a load ring, a lock ring, a pin, or a lug.

4. The downhole tool according to claim 1, further comprising a ball seat located on the inner sleeve at a location above the second valve.

5. The downhole tool according to claim 4, wherein a ball engages with the ball seat to create a seal and a pressure differential, and wherein the pressure differential causes shifting of the inner sleeve.

6. A method of reverse cementing in a wellbore comprising:

introducing a casing string and a downhole tool installed within the casing string into the wellbore, wherein the downhole tool comprises:

a body configured to fit within a casing string;

an inner sleeve located within the body;

a first valve located within the body and configured to open and close a fluid flow path through the body; and a second valve located within the body and configured to open and close the fluid flow path through the body, wherein the first valve is in an open position and the second valve is in a closed position during introduction of the casing string and the downhole tool into the wellbore;

causing the inner sleeve to shift after introduction of the casing string and the downhole tool into the wellbore, wherein the first valve converts to a closed position and the second valve converts to an open position after the inner sleeve has shifted; and introducing a cement composition into an annulus located between a wall of the wellbore and an outside of the casing string.

7. The method according to claim 6, further comprising a ball seat located on the inner sleeve at a location above the second valve.

8. The method according to claim 7, further comprising introducing a ball into the casing string and the inner sleeve, wherein the ball engages with the ball seat to create a seal and a pressure differential, and wherein the pressure differential causes shifting of the inner sleeve.

9. The method according to claim 8, further comprising causing or allowing the ball to disengage from the ball seat after the inner sleeve has shifted.

10. The method according to claim 6, further comprising a valve connector housing, wherein the inner sleeve is releasably attached to the valve connector housing by a frangible device, and wherein the inner sleeve is shifted after shearing of the frangible device.

11. The method according to claim 6, wherein shifting of the inner sleeve causes a flapper of the first valve to rotate into the closed position via a hinge located on a first valve body.

12. The method according to claim 6, wherein a lower end of the inner sleeve causes a flapper on the second valve to rotate into the open position via a hinge located on a second valve body during shifting of the inner sleeve.

13. The method according to claim 6, further comprising a valve connector housing, an inner sleeve shoulder, and a valve connector housing shoulder, wherein the inner sleeve shifts in a downward direction until the inner sleeve shoulder shoulders up against the valve connector housing shoulder.

14. The method according to claim 13, wherein the inner sleeve and the valve connector housing include a lock ring, and wherein the lock ring locks after shifting of the inner sleeve.

15. The method according to claim 9, wherein a bottom portion of the inner sleeve comprises a plurality of fingers, and wherein the fingers expand away from each other allowing the ball to disengage from the ball seat and flow through the fingers into the wellbore.

16. The method according to claim 9, wherein the ball seat comprises a plurality of buttons, wherein the buttons are positioned within a plurality of receivers located around a periphery of the inner sleeve, and wherein shifting of the inner sleeve allows the ball to push the buttons radially outward and disengage from the ball seat.

17. The method according to claim 6, further comprising introducing a first fluid into the annulus prior to introduction of the cement composition.

18. The method according to claim 17, wherein the first fluid is a spacer fluid.

19. The method according to claim 6, wherein hydrostatic equilibrium is achieved during and after introduction of the cement composition.

20. The method according to claim 6, further comprising pressure testing the casing string before, during, or after the cement composition has been introduced into the annulus, and wherein the cement composition is in a fluid form during the pressure testing.

* * * * *